US005359827A

United States Patent [19]

Gehman

[11] Patent Number: 5,359,827

[45] Date of Patent: Nov. 1, 1994

[54] HOLLOW FENCE POST ATTACHMENT FIXTURE

[75] Inventor: N. James Gehman, 242 Buchanan Dr., Ephrata, Pa. 17522

[73] Assignees: M. Dorothy Gehman; N. James Gehman, Ephrata, Pa.

[21] Appl. No.: 116,710

[22] Filed: Sep. 7, 1993

[51] Int. Cl.[5] ..... E04C 5/12

[52] U.S. Cl. ..... 52/698; 256/DIG. 5

[58] Field of Search ..... 256/1, 65, 68, 69, DIG. 5; 52/698; 248/245, 257

[56] References Cited

U.S. PATENT DOCUMENTS

| | | | |
|---|---|---|---|
| 1,135,817 | 4/1915 | Klein et al. . | |
| 4,124,198 | 11/1978 | Wong . | |
| 4,390,165 | 6/1983 | Murdock . | |
| 4,516,756 | 5/1985 | Beatty | 256/1 |
| 4,702,459 | 10/1987 | Moschner . | |
| 4,809,995 | 3/1989 | Veilleux . | |
| 4,815,713 | 3/1989 | Schmanski . | |
| 4,819,916 | 4/1989 | Wun-chung . | |

FOREIGN PATENT DOCUMENTS

| | | | |
|---|---|---|---|
| 0163320 | 6/1989 | Japan | 52/698 |
| 0146363 | 5/1992 | Japan | 256/1 |
| 0361908 | 6/1962 | Switzerland | 248/245 |

*Primary Examiner*—Edward K. Look
*Assistant Examiner*—Christopher Verdier
*Attorney, Agent, or Firm*—Martin Fruitman

[57] ABSTRACT

The invention is a support and retainer fixture for hollow fence posts. Angle irons extending up from a bottom plate are oriented with their corners on the inside of the structure and their legs pointed outward. The top ends of the angle irons are cut at a slope with the inside edges being lower than the outside edges. A top plate with a center hole has edges which are bent upward to match the angles formed on the ends of the angle irons and is held in place by a center threaded stud. When a hollow post is slipped down over the assembly and a nut tightened down onto the top plate, the top plate's edges force the top ends of the angle irons out toward the inside surface of the hollow post, locking it in place.

7 Claims, 2 Drawing Sheets

HOLLOW FENCE POST ATTACHMENT FIXTURE

FIELD OF THE INVENTION

This invention deals generally with fences and more specifically with hollow plastic fences and their attachment to the floors of such structures as wooden decks and other surfaces such as concrete and PVC.

BACKGROUND OF THE INVENTION

The benefits of plastic for fences which are used where they are subject to weathering and corrosion are generally well recognized. Fences using much materials are light weight, strong, and attractive. They can be made with color integrated into the material so that they do not need frequent painting during their use, and possibly their greatest asset is the inherent weather resistance of the materials. A plastic structure such as a fence post can be expected to last as long as anyone wants it to, even in the most severe environment, with no sign of deterioration, and it will not require any maintenance.

However, to attain the economy available from such materials, most plastic fence posts are manufactured as hollow structures, and then relatively expensive fittings are required to attach them to a base structure such as a wooden floor. Furthermore, since the typical floor flange is attached to the hollow plastic post with bolts or other fasteners which penetrate holes near the bottom of the post, the post structure is subjected to severe stress at the holes when any forces are applied transverse to the post. Thus, the force of anyone leaning on the fence post or on a cross rail which transmits force to the post my cause a hollow post to crack at the flange attachment holes.

One structure which can be used to overcome such failures is a long socket into which the post fits. Such a structure spreads the force over a larger area and prevents stress fractures. However, such socket type fittings are both costly and unsightly. The beauty and the simplicity of a simple straight post is lost when a complex structure must be used around a large section at the bottom of the post to strengthen it and attach it to a floor.

SUMMARY OF THE INVENTION

The present invention furnishes a new fixture for attaching hollow posts to a floor, and the fixture is not only completely out of sight once it is installed, but it also increases the strength of the fence post. This is accomplished by using a metal fixture around which the hollow post fits, and by designing the fixture so that it can be expanded to grip and support a long length on the inside surfaces of the hollow post.

The preferred embodiment of the invention uses a hollow plastic post with a square cross section, and once the post is installed on, for instance, the floor of a porch or deck, the post appears to simply butt down against the floor, without any attachment device. The attachment fixture of the invention is completely enclosed within the hollow fence post, and is not at all visible.

The attachment fixture is constructed upon a base plate with holes through which are set screws which hold the plate onto the floor. For the preferred embodiment, the base plate is a square plate to match the square cross section shape of the hollow post. At each corner of the base plate is attached an angle iron, oriented with its length approximately perpendicular to the base plate and extending in a vertical direction. These angle irons are, however, placed in an unusual orientation relative to the corners of the base plate. Instead of the conventional layout with the angles of the angle irons being parallel to the angles of the corners of the base plate, the Junctions of the legs of the angle irons are located pointed in toward the center of the base plate. Each leg of each angle iron is therefore approximately perpendicular to a side of the base plate and the angles of the angle irons enclose the corners of the base plate. Thus, all the edges of the legs of the angles of the angle iron are pointed outward from the skeletal box formed by the angle irons.

The tops of the angle irons, the ends most remote from the base plate, are cut so that they are at an angle to the length dimension of the angle iron. These end angles are made so that the outside edges of the angle irons are longer and terminate higher than the inside edges.

A top plate is used to close the top of the attachment fixture. This top plate has a center hole through which extends a rod whose other end is attached to the base plate. The rod is threaded in the region where it passes through the top plate, so that a nut screwed onto the rod holds the top plate in location, and when the nut is tightened down it presses the top plate against the top edges of the angle irons.

For the preferred embodiment, the top plate is square and dimensioned so that its corners engage the upper edges of the angle irons. The corners of the top plate are bent upward out of the plane of the top plate so that they approximately match the cuts of the angles at the tops of the angle irons.

Because the angles at the corners of the top plate approximately match the angles cut at the ends of the angle irons, when the nut is tightened on the center rod and the top plate is pressed against the upper edges of the angle irons, the top plate forces the tops of the angle irons out, from the center of the fixture. It is this expansion action which acts to lock the fixture against the inside surfaces of a hollow post which is placed around the fixture.

Proper selection of dimensions of the base plate, the spacings of the angle irons on the base plate, the top plate and the inside dimensions of the hollow post permits just enough clearance to slip the post down over the attachment fixture and yet furnish contact between large portion of the angle iron edges and the inside surfaces of the hollow post when the tightening down of the top plate expands the fixture. The tightening of the nut onto the center stud can easily be accomplished through the top of the post with an extension on a ratchet wrench, and an added advantage of the invention is the ability to easily loosen and remove the post at a later time.

The present invention thereby furnishes a simple, inexpensive attachment fixture for hollow posts with the fixture completely hidden by the post itself, and with the fixture providing both rigid attachment and added strength for the post.

DETAILED DESCRIPTION OF THE PREFERRED EMBODIMENT

Figure 1:
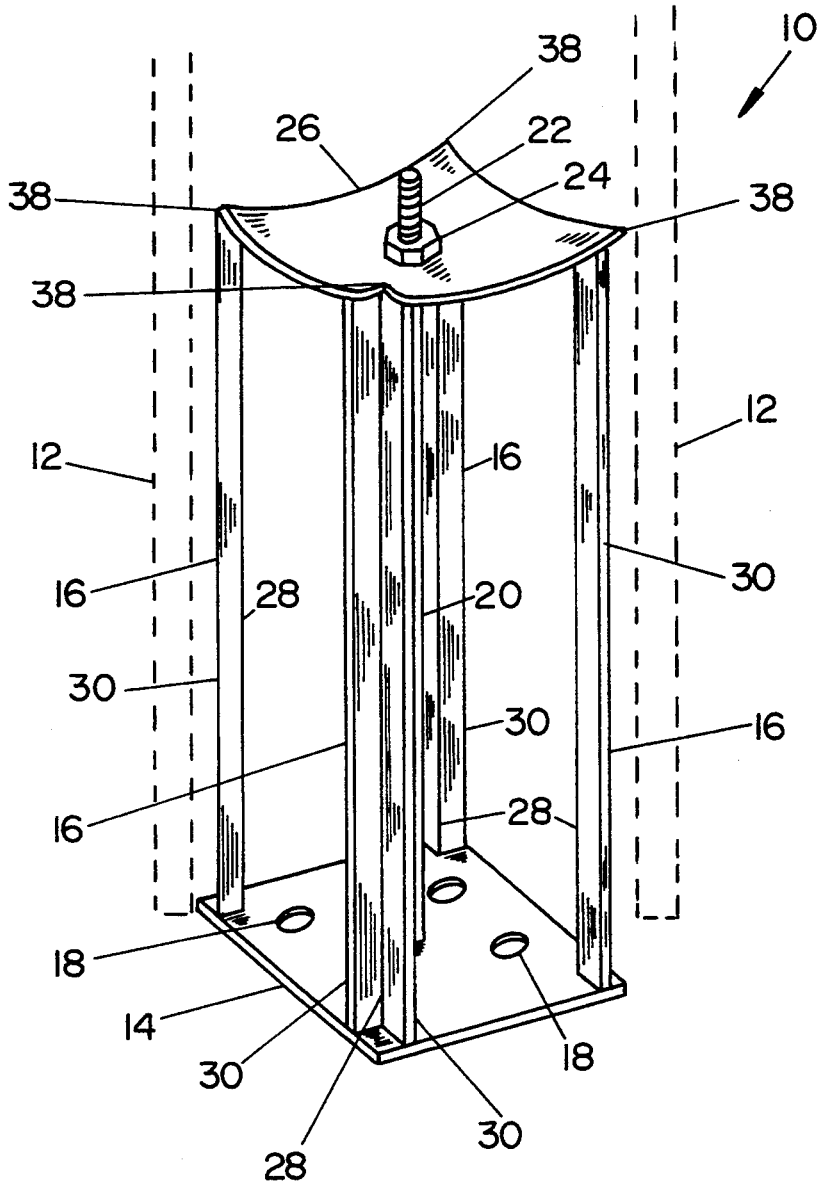
FIG. 1 is a perspective view of the preferred embodiment of the invention.

FIG. 1 shows a perspective view of the preferred embodiment of the invention in which attachment fixture 10 is shown located within a hollow post whose walls 12 are depicted with dashed lines.

Attachment fixture 10 is constructed upon base plate 14 to which are attached, typically by welding, angle irons 16. Base plate 14 has several holes 18 through it, so that it can be attached to a wooden floor (not shown) by screws (not shown) through holes 18. Base plate 14 also has rod 20 attached to it, also typically by welding, at its approximate center. Rod 20 extends beyond the top of fixture 10 and has a threaded portion 22 at its end most remote from base plate 14 upon which nut 24 is threaded.

Top plate 26 is retained attached to fixture 10 by rod 20 going through a hole (not shown) in top plate 26 and nut 24 being tightened down upon top plate 26.

As shown in FIG. 1, angle irons 16 are each located near a corner of base plate 12, which in the preferred embodiment shown is a square plate, and each angle iron 16 is oriented with the apex 28 of its angular cross section located inward from the edges 30 of the legs of the angle iron. Edges 30 of angle irons 16 are all near the perimeter of base plate 14, while apex 28 of each angle iron 16 is closer to the center of base plate 14 than are its edges 30.

Figure 2:
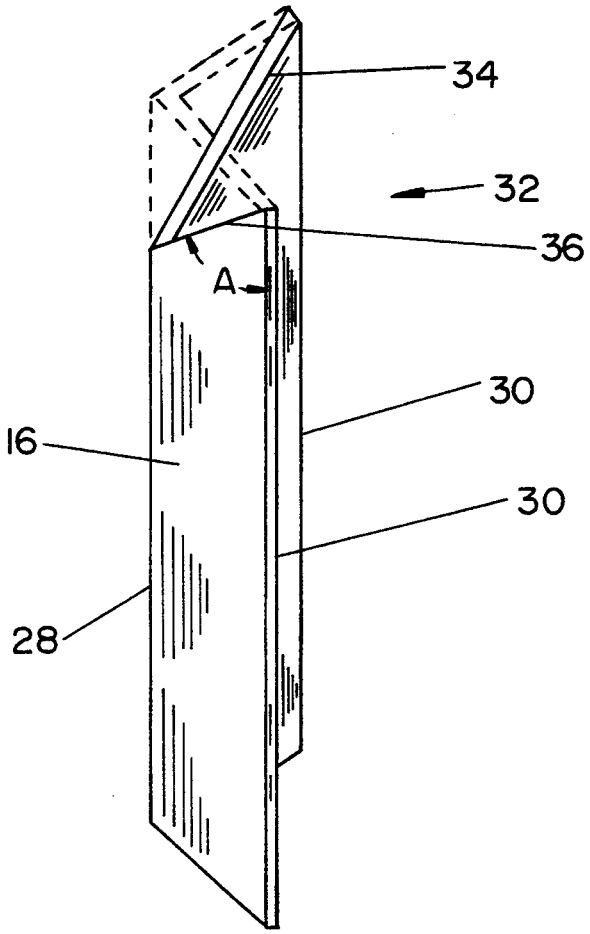
FIG. 2 is a perspective view of one of the angle irons of the preferred embodiment showing the angular cut at the top end of the angle iron.

FIG. 2 shows the structure of top end 32 of each angle iron 16, with top end 32 being defined as the end most remote from base plate 14. As seen in FIG. 2, end edges 34 and 36 at top end 32 of angle iron 16 are cut at an acute angle relative to outside edges 30 of angle iron 16. FIG. 2 depicts in dashed lines the location of end edges 34 and 36 if they were cut at right angles to edges 28 and 30, but for the present invention acute angle A between end edges 34 and 36 and leg edges 30 should be in the range of between 10 and 80 degrees.

Referring again to FIG. 1, it can be seen that corners 38 of top plate 26 are each bent upward so that some portion of each corner 38 is either tangent or parallel to the end edge (34 and 36 in FIG. 2) of the angle iron 16 against which it rests. With such a configuration, when top plate 26 is forced down against angle irons 16, angle irons 16 will be moved away from each other and be forced against sides 12 of the hollow post. Many other top plate shapes will also act to expand the fixture by forcing the angle irons away from each other. Perhaps the simplest is a planar top plate with the Corners cut off. In such a structure the edges of the cut corners contact the end edges of the angle irons and push the angle irons apart as the-top plate is moved along rod 20 and closer to base plate 14.

The operation of fixture 10 is as follows. Fixture 10 is first attached to a base structure such as a deck floor, by using screws through holes 18. Then, with nut 24 loose on threaded portion 22 of rod 20, angle irons 16 can be deflected slightly inward toward rod 20, if they do not already have such an orientation, and the hollow post with walls 12 can be slipped down over fixture 10.

Nut 24 is then tightened down upon top plate 26 and upward angled corners 38 of top plate 26 engage the angled end edges of angle irons 16. If the post has substantial length above top plate 26, it is only necessary to use a socket extension to access nut 24 through the open top of the post. As nut 24 is tightened more, angled edges 38 of top plate 26 force angle irons 16 outward from the axis of fixture 10 and edges 30 of angle irons 16 engage walls 12 of the post. It is this expansion action which locks the post into place while angle irons 16 add to the strength of the post.

The present invention thereby furnishes a simple, inexpensive device for attaching hollow posts to a floor, and offers the further advantage of strengthening the post while still affording easy and simple removal if required.

It is to be understood that the form of this invention as shown is merely a preferred embodiment. Various changes my be made in the function and arrangement of parts; equivalent means my be substituted for those illustrated and described; and certain features my be used independently from others without departing from the spirit and scope of the invention as defined in the following claim.

For example, other cross sections my be used for posts. If a cylindrical post is used, top plate 26 can be formed as a drawn cup with its entire edge angled upward. Moreover, the specific number of angle irons my be changed, provided at least two are used to derive the expansion action. Furthermore, the attachment fixture is not limited to fence posts, and can be used with other hollow posts such as clothes poles or light posts.

What is claimed as new and for which Letters patent of the United States are desired to be secured is:

1. An attachment fixture for hollow posts comprising:

a base plate with boundaries, a center and attachment means for attaching the base plate to a support structure;

at least two angle irons attached to a surface of the base plate, the angle irons extending transverse from the base plate and constructed with an angular cross section, with the angular cross section formed by two legs which meet at an apex, so that the angle irons each have three edges, an apex edge located at the apex of the angle and two leg edges on the edges of the legs remote from the apex, the angle irons being oriented on the base plate so that the leg edges are adjacent to a base plate boundary and the apex edge is located nearer to the center of the base plate than the leg edges, the angle irons also formed with end edges at the ends of the leg edges remote from the base plate and an acute angle between each leg edge and its end edge;

a rod attached to the base plate and extending from the base plate in the same direction as the angle irons, the rod being located on the base plate between the angle irons, extending at least as far from the base plate as the angle irons, and including an end portion adjacent to its end remote from the base plate;

a top plate with a hole through which the rod extends and including contact surfaces contacting the end edges of the angle irons so that moving the top plate along the rod and toward the base plate moves the contact surfaces along the end edges of the angle irons and nearer to the angle iron apexes and forces the end edges of the angle irons to move away from each other; and a fastener attached to the end portion of the rod and forcing the top plate toward the base plate and against the end edges of the angle irons.

2. The fixture of claim 1 wherein the attachment means of the base plate are holes.

3. The fixture of claim 1 wherein the end portion of the rod is threaded and the fastener is a nut.

4. The fixture of claim 1 wherein the contact surfaces of the top plate are angled surfaces parallel to the end edges of the angle irons.

5. The fixture of claim 1 wherein the contact surfaces of the top plate are angled surfaces parallel to the end edges of the angle irons and are located at corners of the tap plate.

6. The fixture of claim 1 wherein the acute angles between the leg edges and the end edges are in the range between 10 and 80 degrees.

7. The fixture of claim 1 wherein the boundaries of the base plate form a square.

* * * * *